United States Patent [19]

Nishimoto

[11] Patent Number: 4,554,857

[45] Date of Patent: Nov. 26, 1985

[54] ELECTRONIC MUSICAL INSTRUMENT CAPABLE OF VARYING A TONE SYNTHESIS OPERATION ALGORITHM

[75] Inventor: Tetsuo Nishimoto, Hamamatsu, Japan

[73] Assignee: Nippon Gakki Seizo Kabushiki Kaisha, Hamamatsu, Japan

[21] Appl. No.: 499,225

[22] Filed: May 31, 1983

[30] Foreign Application Priority Data

Jun. 4, 1982 [JP] Japan ..... 57-94692

[51] Int. Cl.[4] ..... G10H 1/057; G10H 7/00

[52] U.S. Cl. ..... 84/1.19; 84/1.24; 84/1.27

[58] Field of Search ..... 84/1.01, 1.11–1.13, 84/1.19–1.27, DIG. 10

[56] References Cited

U.S. PATENT DOCUMENTS

| | | | |
|---|---|---|---|
| 3,510,567 | 5/1970 | Fisher | 84/1.25 |
| 3,881,387 | 5/1975 | Kawakami | 84/1.24 |
| 3,999,458 | 12/1976 | Suzuki | 84/1.01 |
| 4,018,121 | 4/1977 | Chowning | 84/1.01 |
| 4,106,383 | 8/1978 | Dittmar | 84/1.01 |
| 4,249,447 | 2/1981 | Tomisawa | 84/1.01 |
| 4,253,367 | 3/1981 | Hiyoshi et al. | 84/1.22 |
| 4,283,983 | 8/1981 | Kashio | 84/1.19 |
| 4,300,435 | 11/1981 | Schmoll, III | 84/1.19 |
| 4,301,704 | 11/1981 | Nagai et al. | 84/1.22 |

FOREIGN PATENT DOCUMENTS

| | | |
|---|---|---|
| 48720 | 5/1978 | Japan . |
| 7733 | 1/1980 | Japan . |
| 142397 | 11/1980 | Japan . |

*Primary Examiner*—S. J. Witkowski

*Attorney, Agent, or Firm*—Spensley Horn Jubas & Lubitz

[57] ABSTRACT

This electronic musical instrument has plural operation units respectively performing a predetermined basic waveform generation operation (e.g., frequency modulation operation) using a phase signal representing a pitch of a tone to be produced or a waveform signal generated by the operation unit. There is further provided a setting section for variably setting a combination of input and output connections between the respective operation units as freely as the performer desires. The input and output connections between the operation units are switched according to the set combination. An operation algorithm for tone synthesis is determined according to the combination of connections between the operation units set in this manner whereby a free tone synthesis as desired by the performer is realized. A display is provided for visually indicating the set combination of connections and a state of connection between the respective operation units is indicated as a graphic pattern on this display.

23 Claims, 13 Drawing Figures

ELECTRONIC MUSICAL INSTRUMENT CAPABLE OF VARYING A TONE SYNTHESIS OPERATION ALGORITHM

BACKGROUND OF THE INVENTION

This invention relates to an electronic musical instrument of a type which synthesizes a tone by a waveform generating operation such as a frequency modulation operation or an amplitude modulation operation. The invention relates more particularly to a synthesizer type electronic musical instrument which comprises a plurality of operation units (operators) for waveform generating operation and enables a performer to set a desired combination of input and output connection between these operation units.

A method or apparatus for synthesizing a tone of a desired tone color by a frequency modulation operation in audio frequency band or the like operation is disclosed in the specifications of U.S. Pat. No. 4,018,121 and Japanese Patent Preliminary Publication No. 7733/1980. For performing the tone synthesis by such frequency modulation operation more effectively, attempts are presently being made to employ a plurality of operation units and synthesize a tone of a predetermined tone color by suitably combining these operation units. In the prior art electronic musical instrument, however, the combination of the operation unit, i.e., algorithm of the frequency modulation operation, is previously set in correspondence to a specific tone color and the performer can only select a desired tone color by manipulating a tone color selection switch. The performer cannot set the combination of operation units, i.e., the algorithm of the frequency modulation operation as he desires but some algorithm of frequency modulation operation is selected within the musical instrument as a result of the manipulation of the tone selection switch. Besides, the prior art electronic musical instrument is directed not to selection of the algorithm of frequency modulation operation but to synthesis of a certain tone color and hence not many kinds of algorithms are provided but a mere switching operation between multinominal operation or multiplexing operation is performed.

In the field of electronic musical instruments, there are not only instruments of a type in which a present tone color is selected by a tone color selection switch but also instruments of a type, such as a music synthesizer, in which the performer can create a desired tone (tone color) by manipulating various switches and potentiometers. The latter type of instrument has an excellent characteristic in exploring musical possibility of the electronic musical instrument. The conventional musical synthesizer, however, is an analog control type apparatus employing a voltage and current control type circuit and there is limitation in the application of this system to a digital type electronic musical instrument employing the frequency modulation operation. It has therefore been desired to realize a synthesizer type instrument in the electronic musical instrument of the frequency modulation operation type in which the performer can synthesize any tone (tone color) as freely as he desires. This requirement exists not only in the frequency modulation operation type electronic musical instrument but also in an electronic musical instrument employing a tone synthesis system based on an amplitude modulation operation in the audio frequency band such as one disclosed in the specification of Japanese Patent Preliminary Publication No. 48720/1978.

It is, therefore, an object of the present invention to provide, in an electronic musical instrument of a type which synthesizes a tone by a modulation operation employing one or more phase signals or waveform signals in, for example, a frequency modulation operation or amplitude modulation operation, a synthesizer type electronic musical instrument according to which the performer can synthesize any tone (tone color) as freely as he desires.

SUMMARY OF THE INVENTION

This object of the invention can be realized by enabling an algorithm of the modulation operation to be set freely by the performer. There are provided a plurality of operation units which perform predetermined operations employing one or more phase signals or waveform signals as inputs thereof. There are also provided setting means for variably setting a combination of input and output connections between respective operation units and connection switching means for switching the input and output connections between the respective operation units according to the combinations of connections set by this setting means. Various algorithms in the frequency modulation operation or amplitude modulation operation are realized by taking an operation performed in one operation unit as one unit and combining plural operation units in various manners. By this arrangement in which the algorithm of the modulation operation is freely set as desired by the performer, a free synthesis of a tone (tone color) by the performer is made possible. Operation parameters in the respective operation units can be set freely and further variety of tones (tone colors) can thereby be synthesized in one algorithm (i.e., combination of connections).

In relation to the setting means, it is preferable to provide indication means for indicating a combination of connections between the respective operation units which is presently set in the setting means. Such indication means indicates what operation algorithm the performer has set and thereby greatly helping the performer change the set algorithm and hence improving the function as the synthesizer.

By way of example, many sets of combination of input and output connections of the respective operation units are prepared and the setting means comprises means for selecting one out of these sets. These sets are distinguished by an algorithm number and a combination of connections of operation units corresponding to an algorithm number selected by an algorithm number selection operation is indicated by the indication means. The setting means may comprise not only the algorithm number selection means but, in addition, means for inhibiting an output of a selected operation unit. By utilizing such inhibition means, an operation algorithm which has not been prepared previously can be formed (i.e., algorithm corresponding to the algorithm number can be altered).

As the setting means, a device may be employed which, instead of using means selecting a prepared algorithm, sets a desired algorithm by combination of a key designating the number of an individual operation unit and a function key designating an input and output connection function. It is also possible to provide an arrangement such that a desired algorithm can be selected by drawing a desired connection line between the respective operation units on the display by employing a CRT display device and a write pen.

In the frequency modulation operation or amplitude modulation operation, it has been found effective to use a circulating type operation unit which feeds back its output to one of inputs thereof. An example of such circulating type of operation unit in the frequency modulation operation is disclosed in the specification of Japanese Patent Preliminary Publication No. 7733/1980. The circulating type operation circuit has the advantages that it can synthesize a signal having a spectrum distribution of wide application with abundant harmonic contents and a monotone decreasing characteristic which increases in level as the order of harmonics decreases and vice versa. That circuit can easily control the number of harmonics by controlling the feedback ratio of a signal to be fed back from its output to its input. It is therefore advantageous to use such circulating type operation circuit for any of the operation units. In that case, it is very important in performing setting operations for the tone synthesis such as a manner of setting an operation parameter to recognize which operation unit is made the circlating type. In the embodiment of the invention, therefore, a predetermined additional display indicating the circulating type is added to the display of an operation unit used as the circulating type operation circuit when the indication of the combination of connections of the respective operation units is indicated.

Depending upon the manner of setting the operation algorithm, there arises a case where signals synthesized in plural channels are finally added and provided as a tone signal. In this case, the level of the output tone signal is subject to variation depending upon the number of the addition channels, which is a very undesirable phenomenon. In the present invention, there is provided means for automatically adjusting the level of the output tone signal in accordance with the number of the addition channels in each algorithm so that the level of the output tone signal is maintained at a constant level regardless of a set algorithm, i.e., the manner of combination of connections of the operation units.

The operation units may be composed of individual hardwares but it is more economical to provide a single operation unit hardware and use this single hardware commonly for plural operation units on a time shared basis. In the embodiment illustrated in the accompanying drawings, the term "operator" corresponds to the operation unit.

In the input and output connection of the operation units, an output and an input can be connected by a simple connection whereas connection of two or more outputs involves some operation factor such as addition or subtraction. Accordingly, the term "input and output connection" signifies not only a simple wiring connection but also a connection involving addition or subtraction.

BRIEF DESCRIPTION OF THE DRAWINGS

In the accompanying drawings,

FIG. 2(*b*) is a time chart showing time division operator time slots;

FIG. 2(*c*) is a time chart showing an example of a timing signal;

FIG. 6 is a graphical diagram showing a typical example of an envelope shape generated in response to depression of a key and utilized as an operation parameter varying with;

DESCRIPTION OF A PREFERRED EMBODIMENT

Figure 1:
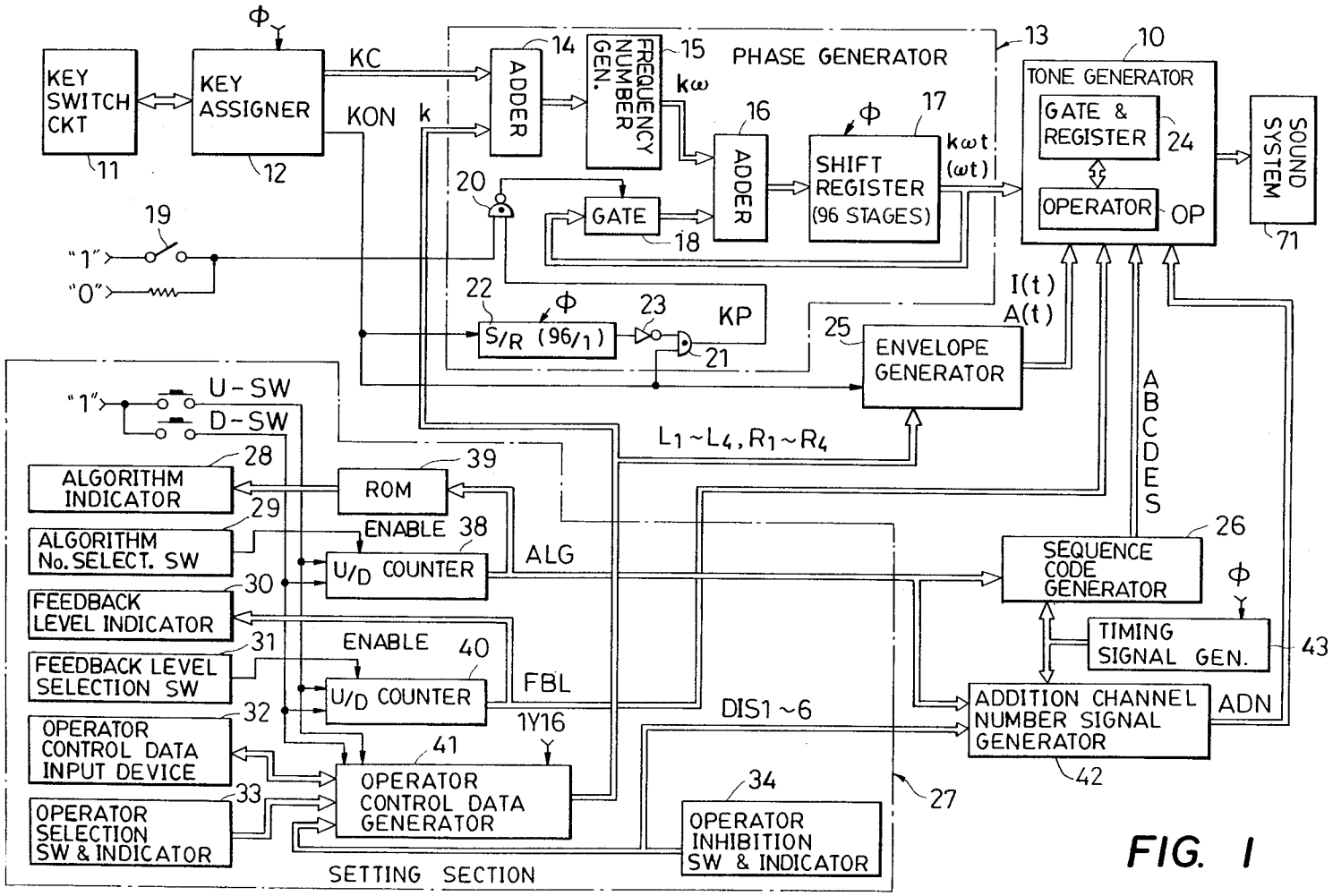
FIG. 1 is an electrical block diagram showing an entire construction of an embodiment of the electronic musical instrument according to the invention.

FIG. 1 shows an embodiment of the invention applied to an electronic musical instrument employing a tone synthesis system based on a frequency modulation operation. In this rmbodiment, the frequency modulation operation for synthesizing a tone signal for one tone is performed by employing six operators or operation units. An operator OP is included in a tone generator 10. In this embodiment, a hardware of a single operator OP for performing a basic frequency modulation operation is provided in the tone generator 10 and this single operator OP is used on a time shared basis at six time slots corresponding to six operators whereby the operation function by six independent operators is virtually realized. In the electronic musical instrument of this embodiment, the maximum number of tones to be sounded simultaneously is 16 and operation for each tone is performed by utilizing a single operator in time division at 16 time slots. The 16 time division time slots corresponding to the respective tones are hereinafter referred to as "tone generation channels" or simply "channels."

Figure 2:
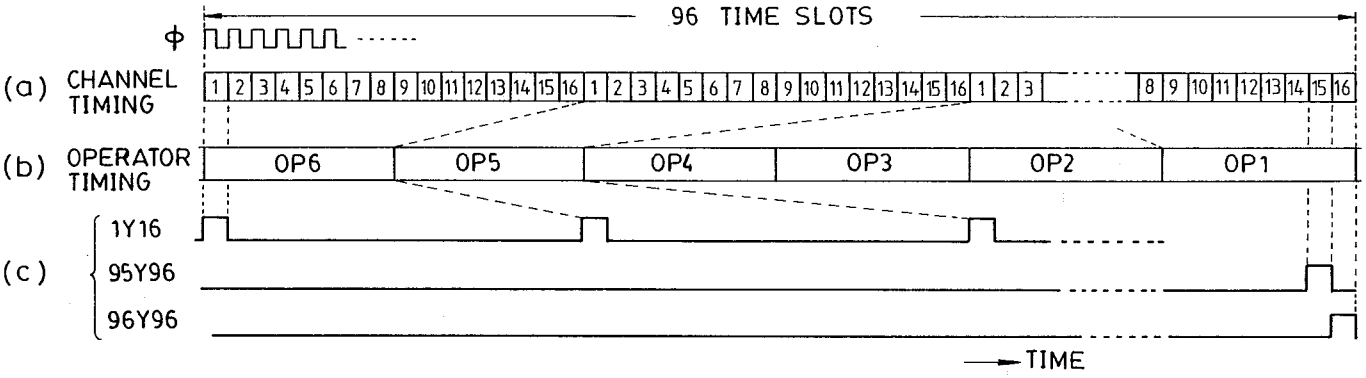
FIG. 2(*a*) is a time chart showing time division channel timing.

Examples of the time division time slots for the respective channels and those for the respective operators are shown in FIGS. 2(*a*) and 2(*b*). As to channel timing, time slots corresponding to the first through sixteenth channels are provided in sequence in synchronism with a clock pulse $\phi$ and channel timing circulates sequentially and repetitively. As to operator timing, a time slot for one operator corresponds to time width of 16 time slots of the channel timing and time slots OP 6–OP 1 for operators 6 to 1 are provided in sequence. For example, at the time slot of the first channel in the time slot OP 6 for the operator 6, operation in the operator 6 concerning a tone which has been assigned to the first channel is carried out. Again, at the time slot of the first channel in the time slot OP 5 for the operator 5, operation in the operator 5 concerning the tone which has been assigned to the first channel is carried out. Thus, a period of time in which the time shared operation in the six operators for all tones of 16 channels completes one cycle is 96 time slots corresponding to $16\times6=96$ clock pulses $\phi$. Hereunder the operators corresponding to the respective time slots OP 5–OP 1 of the operator timing are identified by numbers 6, 5, 4, 3, 2 and 1. A timing signal 1Y16 shown in FIG. 2(*c*) is generated as a shot of pulse at the first channel timing with a period of 16 time slots (when the term "time slot" is used herein as expression of unit of time, one time slot means one period of the clock pulse $\phi$). A timing signal 95Y96 is generated as a shot of pulse at the fifteenth channel timing in the time slot OP 1 of the operator 1 with a period of 96 time slots.

In FIG. 1, a key switch circuit 11 comprises key switches corresponding to respective keys in the keyboard and produces outputs corresponding to depression and release of the respective keys. A key assigner 12 assigns, responsive to the output of the key switch circuit 11, sounding of a tone corresponding to a depressed key to available one of the 16 channels. Key codes KC representing depressed keys assigned to the respective channels and key-on signals KON representing whether those keys are still being depressed or have already been released are outputted in time division from the key assigner 12. The key codes KC are supplied to a phase generator 13. The phase generator 13 produces phase angle data $\omega t$ whose value changes at a rate corresponding to tone frequency $\omega$ of the key represented by the key code KC. As will be described later, a frequency control coefficient k is inputted to the phase generator 13 as one of parameters of the frequency modulation operation. When $k=1$, the output phase angle data is $\omega t$ whereas when $k\neq1$, the frequency $\omega$ is changed and the output phase angle data becomes $k\omega t$.

In the phase generator 13, the key code KC is applied to an adder 14 where it is added to the frequency coefficient k. The adder 14 is provided for changing the value of the key code KC in response to the coefficient k. A frequency number generator 15 generates, responsive to the output of the adder 14, numerical data representing an amount of phase change per unit time, i.e., a frequency number.

It is known in the art that a frequency number expressed in logarithm can be obtained by frequently adding data of two low bits of the key code KC to lower bits (e.g., Japanese Patent Preliminary Publication No. 142397/1980). The key code KC is applied to the adder 14 in the form of such frequency number expressed in logarithm. By adding the coefficient k to the logarithmically expressed frequency number (corresponding to the linearly expressed angle frequency $\omega$), an operation equivalent to multiplication for obtaining a product "$k\omega$" is performed. A frequency number generator 15 is constituted of a logarithm-linear converter converting the logarithmically expressed frequency number to the linearly expressed frequency number $k\omega$.

An adder 16, a 96-stage/22-bit shift register 17 and a gate 18 constitute an accumulator which adds cumulatively the frequency number $k\omega$ generated by the frequency number generator 15 with a period of 96 time slots. The frequency control coefficient k provided to the adder 14 is provided for each operator on a time shared basis at the operator timing shown in FIG. 2(*b*). Accordingly, the frequency number generator 15 produces in time division, during 96 time slots, a total of 96 frequency numbers $k\omega$ which correspond to the product of 16 frequency numbers $\omega$ assigned to the respective channels by 6 coefficients k for the respective operators. The frequency number $k\omega$ produced by the frequency number generator 15, therefore, is a signal which repeats with a period of 96 time slots.

For maintaining the accumulated value of different frequency numbers $k\omega$ of 96 time slots, the shift register 17 has 96 stages and is shift controlled by the clock pulse $\phi$. The output of the shift register 17 is supplied to the adder 16 through the gate 18 where it is added to the frequency number $k\omega$ provided by the generator 15. The 96 frequency numbers $k\omega$ are accumulated every 96 time slots whereby phase angle data $k\omega t$ which repeatedly changes at a rate corresponding to the value of the frequency number is obtained. If the coefficient k is $k=1$, the phase angle data $k\omega t$ is $k\omega t=\omega t$, i.e., the phase angle data corresponds to the fundamental frequency of the depressed key. In the following description, output phase angle data of the phase generator 13, including the case of $k=1$, is represented by $k\omega t$.

The gate 18 is provided for initially setting the value of the phase angle data $k\omega t$. The phase angle of a tone signal can be initially set in synchronism with start of key depression and, for this purpose, a synchronizing switch 19 is provided. When the synchronizing switch 19 is in an off state, its output signal which is "0" is inverted by a NAND gate 20 so that a signal "1" is constantly applied to the gate 18 which therefore remains open. When the synchronizing switch 19 is turned on, its output signal "1" is applied to a NAND gate 20 so that the output signal of the NAND gate 20 is determined in response to a key-on pulse KP supplied by an AND gate 21. When the key-on pulse is "0," the output of the NAND gate 20 is "1" so that the gate 18 is open thereby enabling accumulation of the frequency number $k\omega$. A signal obtained by delaying the key-on signal KON by a 96-stage/1-bit shift register 22 by 96 time slots and inverting this delayed signal by an inverter 23 is applied to one input of the AND gate 21. The AND gate 21 receives the key-on signal KON directly at the other input thereof. When the key-on signal KON 96 time slots ago is "0" the output of the inverter 23 is "1." Accordingly, on condition that when the key-on signal KON outputted from the key assigner 12 is "1," the key-on signal KON 96 time slots ago was "0," the AND gate 21 is enabled and the key-on pulse KP is turned to "1." The NAND gate 20 is enabled by this key-on pulse KP to provide a signal "0" to the gate 18. The gate 18 thereby is closed resulting in clearing of the accumulated value which has been held in the register 17.

Upon depression of a new key, the key-on signal KON of a channel to which the key has been assigned rises from "0" to "1." Accordingly, the key-on pulse KP is generated at the time slot of the channel to which the key has been assigned at a start of key depression. The channel timing circulates six times while the key-on signal KON is delayed by 96 time slots in the shift register 22. The key-on pulse KP therefore is generated once in each of the time slots OP 6–OP 1 of the respective operators. Thus, old accumulated values (accumulated values for the respective operators) in the register 17 concerning the channels to which the key has been assigned at the start of key depression are all cleared and computation of the phase angle is started from a predetermined initial phase (e.g., phase angle 0 degree).

In the tone synthesis based on the frequency modulation operation, effects of phases of a carrier signal and a modulating signal on the harmonics composition of a produced tone is not negligible and, accordingly, the initial setting of the phase angle data concerning all of the operators as described above is very effective.

The phase angle data kωt generated by the phase generator 13 is applied to the tone generator 10 (particularly the operator OP). The tone generator 10 includes the operator OP and an algorithm switching gate and register section 24. The operator OP performs a basic frequency modulation operation in response to the phase angle data of a carrier signal and data of a modulating signal. The phase angle data kωt from the phase generator 13 is used as the phase angle data of the carrier signal and an output signal of another operator is used as the data of the modulating signal. The single operator OP performs corresponding frequency modulation operations in the respective operator time slots OP 6–OP 1 in response to the phase angle data kωt (or ωt) provided in time division with a width of 16 time slots and a period of 96 time slots per operator. The algorithm switching gate and register section 24 effects a combination of connection between inputs and outputs of the operators 6–1 in accordance with algorithm set by a performer. Since the respective operators 6–1 assume the form of the time division time slots OP 6–OP 1, the gate and register section 24 temporarily stores the output of the operator OP at a certain operator time slot and applies the temporarily stored operator output to the input terminal of the operator OP as a modulating signal at a predetermined operator time slot corresponding to the combination of input-output connection.

Operation parameters whose values change with lapse of time during the key depression, such as modulation index I(t) or amplitude coefficient A(t), among operation parameters used in the operator OP are provided by an envelope generator 25. Signals for controlling a gate switching operation or a register storing operation in the algorithm switching gate and register section 24 are provided by a sequence code generator 26. The sequence code generator 26 generates codes (control signals) for controlling the sequential operation in the gate and register section 24 in response to the combination of connection of the operator, i.e., algorithm, set in a setting section 27.

Figure 3:
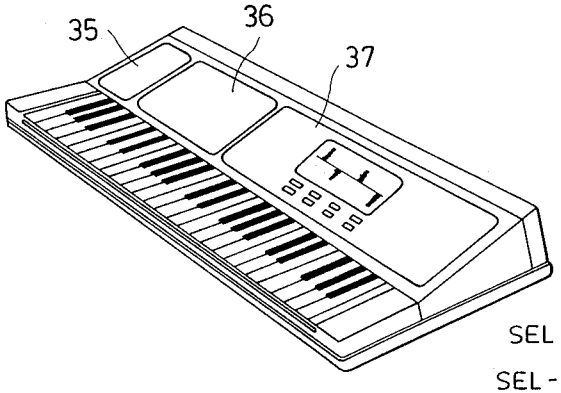
FIG. 3 is a perspective view showing an external appearance of the embodiment of the electronic musical instrument according to the invention.

The setting section 27 is provided for variably setting the combination of connection of input and output in the operators 6–1. The setting of the combination is generally performed by the performer's manual operation. In the setting section 27, switches and indicators 28–34, U-SW and D-SW are arranged in a front panel section of the electronic musical instrument so that they are readily visible and convenient for manipulation of the performer. The appearance of the electronic musical instrument of the present invention is shown in FIG. 3. The panel section provided rearwardly of the keyboard generally consists of an up-down control panel 35, an algorithm control panel 36 and an operator control panel 37.

The up-down control panel 35 is a section used for increasing and decreasing numerical data and includes the up switch U-SW and down switch D-SW shown in FIG. 1.

The algorithm control panel 36 is a section used for setting the combination of connection of the respective operators. In the algorithm control panel 36, an algorithm indicator 28, an algorithm number selection switch 29, a feedback level selection switch 31, an operator selection switch and indicator 33 and an operator inhibition switch and indicator 34 shown in FIG. 1 are arranged in the manner shown in FIG. 4.

The algorithm indicator 28 indicates the state of connection of the six operators 1–6 by the operator number indication "1"–"6" and indication of a connecting line connecting the operators. A light-emitting diode, for example, is used as the indicator element.

Figure 4:
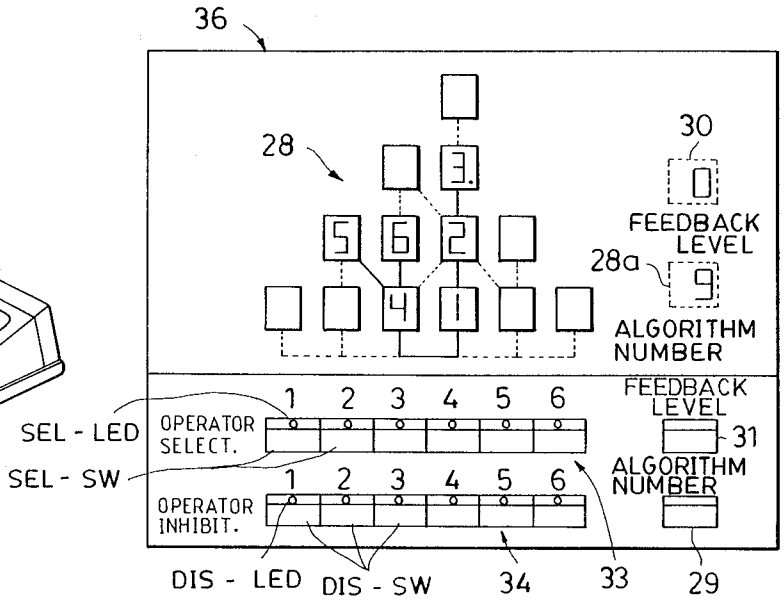
FIG. 4 is a view showing an example of arrangement of switches and indicators in the algorithm control panel in FIG. 3.

In FIG. 4, the upper ends of respective operator number indicating blocks represent inputs and the lower ends thereof represent outputs. If outputs of the operators are depicted as being connected together, such as the operators 1 and 4 or 5 and 6 shown in FIG. 4, it signifies that these outputs are added together. Since, as described above, the output phase angle data kωt of the phase generator 13 (FIG. 1) is inputted to the operators 1–6 as the carrier signal phase angle data, the input and output connections between the operators mean inputting of an output signal of one operator as a modulating signal for another operator (or for itself). In the indicator 28, operators which are depicted as receiving no input signal, such as the operators 5 and 6 in FIG. 4, signify that they receive only the phase angle data kωt from the phase generator 13. Alternatively stated, it signifies that these operators do not perform the frequency modulation operation but functions only as a waveform generation device responsive to the phase angle data kωt. A dot affixed at the right bottom of the number indication such as in the operator 3 in FIG. 4 represents that it is a circulating type operator which feeds back its output signal to its modulating signal input.

Figure 5:
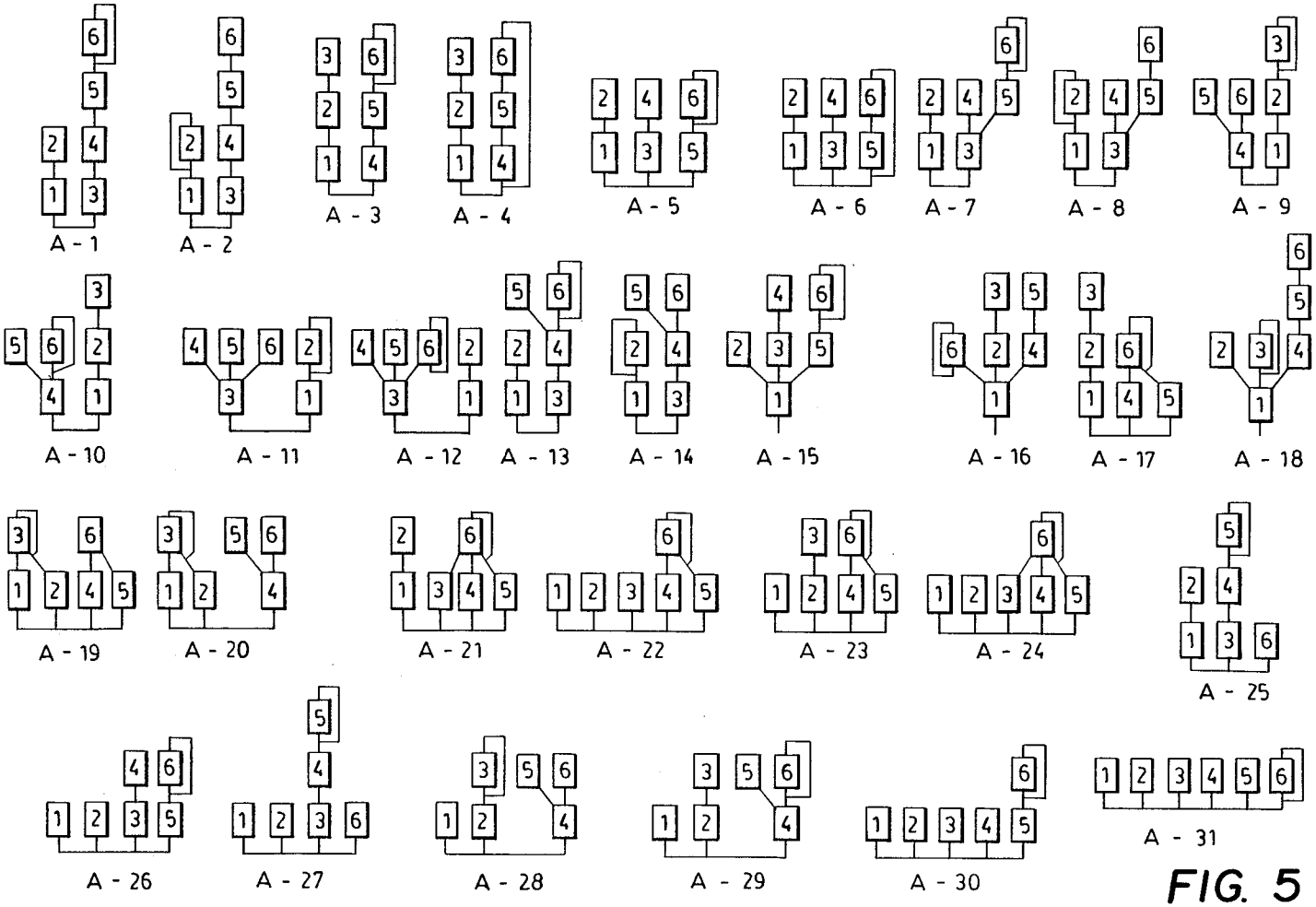
FIG. 5 is a diagram showing 31 combinations of connections of operators, i.e., algorithms.

In association with the algorithm indicator 28, an algorithm number indicator **28*a* (FIG. 4) for indicating a two digit decimal number is provided. In this embodiment, 31 sets of combinations of input and output for each operator are prepared and the algorithm numbers of 1 to 31 are allotted to each of these sets. In this algorithm number indicator 28*a*, the number of algorithm which is presently set, i.e., being indicated by the indicator 28, is indicated. Examples of connections between operators corresponding to the respective algorithm numbers are shown as A-1 through A-31 in FIG. 5. A-1 through A-31 correspond to the algorithm numbers 1 through 31. The numbers "1"–"6" in the blocks in FIG. 5 represent the operators 1–6. FIG. 5 is depicted in the same manner as the representation of the algorithm indicator 28, i.e., the upper ends of the operator blocks represent inputs and the lower ends thereof outputs respectively and connection of outputs of operators signifies that output signals of these operators are added together. The circulating type operators in FIG. 5, however, are depicted by using lines indicating feedback instead of the dot indication. It will be understood from FIG. 5, A-9 that the representation of connections between the operators illustrated by way of example in the algorithm indicator 28 in FIG. 4 corresponds to the algorithm number 9. Accordingly, "9" is indicated in the algorithm number indicator 28*a* in FIG. 4**.

An algorithm number selection switch 29 (FIG. 1 and FIG. 4) is a switch provided for selecting an algorithm number selection mode. By manipulating this switch 29, the setting section 27 enters the algorithm number selection mode and present contents of indication of the number indicator **28*a*** are lighted intermittently to indicate that the algorithm number is selectable. A circuit for the intermittent indication can be constructed by a known technique and is not particularly shown in FIG. 1. In response to the manipulation of the switch 29, an up-down counter 38 in FIG. 1 is set to a count enable state whereby present count is further counted up and down in response to the manipulation of the up switch U-SW and the down switch D-SW respectively.

The count of the counter 38 indicates the presently selected algorithm number and the counting output of this counter 38 is used as an algorithm number signal ALG. Indication pattern ROM 39 previously stores indication pattern data in the algorithm indicator 28 and reads out the indication pattern data in response to the algorithm number signal ALG. The indication element of the algorithm indicator 28 is driven in response to the pattern data read out from the ROM 39 whereby connection between the operators corresponding to the algorithm number is indicated. The count of the counter 38 is indicated in a decimal number by the number indicator 28*a* (FIG. 4), though this is not shown in FIG. 1. In the above described manner, a desired connection between the operators can be selectively set by observing the indication of the algorithm indicator 28 and manipulating the algorithm number selection switch 29 and the up and down switches U-SW and D-SW.

The feedback level selection switch 31 is provided for setting a feedback level in the circulating type operator, i.e., a feedback ratio in feeding back its own output signal to its modulating signal input. As was described previously, which operator presently constitutes the circulating type operator is known from the dot indication on the indicator 28. The feedback level indicator 30 indicates in a numerical value the feedback level which is presently set in this circulating type operator. This feedback level is changed by manipulating the feedback level selection switch 31 and the up and down switches U-SW and D-SW and is monitored by the indicator 30.

Upon the manipulation of the feedback level setting selection switch 31, the setting section 27 enters the feedback level setting mode and the present indication contents of the feedback level indicator 30 are lighted intermittently. The circuit for this intermittent indication can be constructed by a known technique, though such circuit is not particularly shown in FIG. 1. By manipulating this switch 31, an up-down counter 40 in FIG. 1 is set to a count enable state and the present count of the counter 40 is further counted up or down by manipulating the up and down switches U-SW and D-SW. Although the up and down switches U-SW and D-SW are used also for selecting the algorithm number, no particular inconvenience thereby arises for when the setting section has been set to a certain setting mode or selection mode, other modes are always reset. The counting output of the counter 40 is used as data FBL representing the feedback level. The feedback level indicator 30 indicates the value of this feedback level data FBL.

The operator inhibition switch and indicator 34 includes, as shown in FIG. 4, six switches DIS-SW corresponding to the respective operators 1–6 and light-emitting elements DIS-LED provided corresponding to the respective switches. By turning on one of the inhibition switches DIS-SW corresponding to a desired one of the operators 1–6, the output of that operator is inhibited. If, for example, the inhibition switch DIS-SW corresponding to the operator 4 in the connection of the algorithm number 9 illustrated in the algorithm indicator 28 is turned on, the output of the operator 4 is inhibited whereby the channel including the operators 4, 5 and 6 is virturally not used and the algorithm of the number 9 is changed to a serial connection of the operators 3, 2 and 1. The light emitting element DIS-LED corresponding to the turned-on inhibition switch DIS-SW is lighted to indicate which operator is presently inhibited. Plural inhibition switches DIS-SW can be simultaneously turned on.

The operator selection switch and indicator 33 also includes, as shown in FIG. 4, six switches SEL-SW corresponding to the respective operators 1–6 and light emitting elements SEL-LED provided corresponding to the respective switches SEL-SW. The operator control panel 37 shown in FIG. 3 comprises an operator control data input device 32 (FIG. 1) consisting of a switch and an indicator. This operator control data input device 32 is provided for setting and inputting various control data concerning a single operator. The operator selection switch and indicator 33 selects the number of the operator, control data for which is to be inputted to this input device 32. Accordingly, the switches SEL-SW in the switch and indicator 33 cannot be turned on simultaneously and one of the light emitting element SEL-LED corresponding to the single turned-on operator selection switch is lighted.

Figure 6:
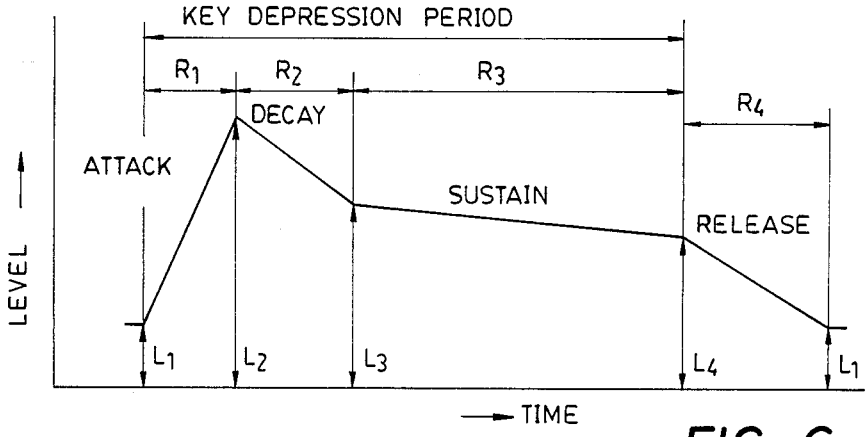

Control factors to be set and inputted by the operator control data input device 32 are the previously described frequency control coefficient k and an envelope shape forming factor which uses as modulation index I(t) or amplitude coefficient A(t). It is well known in the art that an envelope shape consists of four portions of attack curve, decay curve, sustain curve and release curve as shown in FIG. 6, the attack curve starting upon depression of a key and the release curve starting upon release of the key. Such envelope shape forming factors consist of level data and rate data. The level data includes an initial level L1 indicating a level at the start of the attack curve, an attack level L2 indicating a level at the end of the attack level, a decay level L3 indicating a level at the end of the decay curve and a sustain level L4 indicating a level at the end of the sustain curve. The rate data includes an attack rate R1 indicating a slope of the attack curve, a decay rate R2 indicating a slope of the decay curve, a sustain rate R3 indicating a slope of the sustain curve and a release rate R4 indicating a slope of the release curve. The operator control data input device 32 includes selection switches for selecting respective control factors, i.e., the frequency control coefficient k, four level data L1–L4 and four rate data R1–R4 and indicators for indicating present set values of these control factors. In the same manner as in the setting of the algorithm number and feedback level, the control factors are set by manipulating a selection switch corresponding to one desired control factor and thereby setting the setting section 27 to a setting mode of that control factor and increasing or decreasing the present set values of the control factors by manipulating the up and down switches U-SW and D-SW.

The operator control data generator 41 shown in FIG. 1 includes a counter circuit for effecting increase and decrease of numerical values and a register circuit for storing set data corresponding to the respective control factors k, L1–L4 and R1–R4 with respect to each operator. One register corresponding to one operator is selected by the output of the operator selection switch and indicator 33, the presently set data of the respective control factors stored in that register is increased or decreased in response to the output of the input device 32 and the up and down switches U-SW and D-SW and set contents of the respective control factors at every change thereof are transmitted to the indicator of the input device 32 and indicated thereby. Set data (hereinafter simply referred to as "control data") corresponding to the respective control factors k, L1–L4 and R1–R4 of the respective operators stored in the respective registers is repeatedly outputted from the generator 41 in time division in response to the timing signal 1Y16 (FIG. 2) and in synchronism with the individual operator timing OP 6–OP 1. The output of the operator inhibition switch and indicator 34 is applied to the operator control data generator 41 thereby inhibiting outputting of all control data k, L1–L4 and R1–R4 concerning the inhibited operator. The inhibition of the data L1–L4 and R1–R4 inhibits generation of an envelope shape in the envelope generator 25 whereby the amplitude coefficient A(t) is turned to zero and the output of the operator is inhibited.

Among the control data outputted in time division from the operator control data generator 41 in synchronism with the operator timing OP 6–OP 1, the frequency control coefficient k is applied to the adder 14 of the phase generator 13 and the envelope forming data L1–L4 is applied to the envelope generator 25. The envelope generator 25 generates digitally an envelope shape as shown in FIG. 6 in response to the key-on signal KON from the key assigner 12 and the control data L1–L4 and R1–R4. The basic contstruction of the envelope generator 25 is well known and detailed description thereof will be omitted. The envelope generator 25 generates envelope shapes for 16 tones for each of the six operators, totaling 96 different envelope shapes. A single envelope generator is used on a time shared basis with 96 time slots so that 96 different envelope shapes are repeatedly outputted in time division at a period of 96 time slots. The time division timing of the output of the envelope generator 25 is synchronized with the timing of the output $k\omega t$ of the phase generator 13. Thus, the envelope shape signals generated by the envelope generator 25 are utilized in the operator OP of the tone generator 10 as the modulation index I(t) or the amplitude coefficient A(t).

The algorithm number signal ALG outputted from the counter 38 is supplied to the sequence code generator 26 and an addition channel number signal generator 42. The addition channel number signal generator 42 receives also the operator inhibition signals D1S1–6 outputted from the operator inhibition switch and indicator 34.

The sequence code generator 26 previously stores sequence codes (codes consisting of control signals A, B, C, D, E and S) in correspondence to the respective algorithm numbers 1–31 for sequentially controlling the algorithm switching gate and register section 24 in response to the operator time slots OP 1–OP 6 (FIG. 2), enables readout of a set of sequence codes corresponding to one algorithm number in response to the algorithm number ALG, and sequentially outputs this set of sequence codes at each of the operator time slots OP 6–OP 1 in response to the timing signal supplied by the timing signal generator 43. Sequence codes corresponding to the respective algorithm numbers have such contents as will realize connections of the operators shown as A-1 through A-31 in FIG. 5.

The addition channel number signal generator 42 generates a signal representing the number of final addition channels in the presently set combination of connection of the operators, i.e., algorithm. The number of final addition channels means the number of operators whose output signals are finally added together for obtaining a tone signal. In the algorithm number 1 shown as A-1 in FIG. 5, operators whose outputs are finally added together are operators 1 and 3 and the addition channel number is "2". In A-5 in FIG. 5, output signals of the operators 1, 3 and 5 are finally added together so that the addition channel number is "3". In the algorithm of A-15 in FIG. 5, the final operator is operator 1 only so that the addition channel number is "1". In the algorithm of A-31 in FIG. 5, output signals of all operators 1–6 are finally added together so that the addition channel number is "6". Since the addition channel number differs depending upon the set algorithm, the tone level of a final tone signal will become higher as the addition channel number increases if no tone level adjustment is made resulting in deterioration in the balance of the tone level. For eliminating such inconvenience, a signal ADN representing the addition channel number is generated in the addition channel number signal generator 42 and supplied to the tone generator 10 thereby to adjust the output signal level of the final operators of each channel in accordance with this addition channel number. If, for example, the addition channel number is "1" as in A-15 in FIG. 5 and the level ratio of the output signal of the final operator 1 is "1", the level ratios of the last operators 1 and 3 of the respective channels in A-1 in which the addition channel number is "2" are adjusted to "$\frac{1}{2}$" respectively and the level ratios of the last operators 1, 3 and 5 of the respective channels in A-5 in which the addition channel number are adjusted to "3" are "$\frac{1}{3}$, $\frac{1}{3}$, $\frac{1}{3}$" respectively.

As will be apparent from FIG. 5, the addition channel number is known uniquely from the algorithm number. If, however, an output of any operator is inhibited by operatiion of the operator inhibition switch and indicator 34, there can be an occasion in which an actual addition channel number is decreased. For this reason, the addition channel number signal generator 42 uses the output signal of the operator inhibition switch and indicator 34 also in judging the addition channel number.

Figure 7:
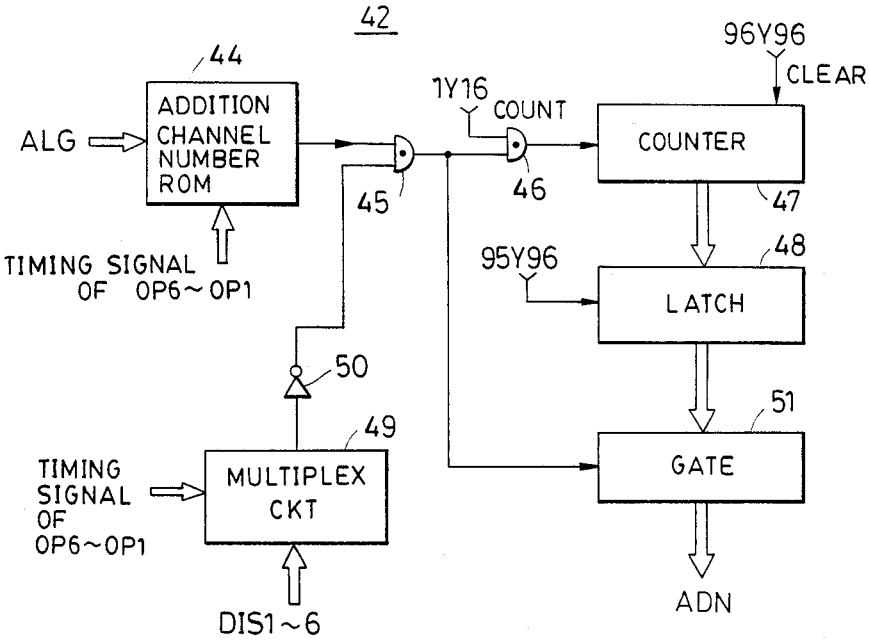
FIG. 7 is an electrical block diagram showing an example of an addition channel number signal generator.

An example of the addition channel number signal generator 42 is shown in FIG. 7. An addition channel number ROM 44 prestores data of the final operator in accordance with the respective algorithm number, selects the data of the final operator corresponding to the presently selected and set algorithm number in response to the algorithm number signal ALG, and provides this final operator data in response to the timing signals representing the operator time slots OP 6–OP 1 supplied by the timing signal generators 43. The final operator data read from the ROM 44 is a bit 1- bit signal which is turned to "1" at the time slot of the final operator. If, for example, the algorithm number signal ALG is "1," the final operators are 1 and 3 as will be apparent from A-1 in FIG. 5 and, accordingly, a pulse signal which is turned to "1" at the operator time slots OP 3 and OP 1 is read out from the ROM 44. As will be understood from this example, at which operator time slots a pulse signal is read out from the ROM 44 in response to the selected algorithm number will be apparent from the operator connection diagram in FIG. 5.

The final operator timing pulse read from the ROM 44 is applied to a count input of a counter 47 through AND gates 45 and 46. The AND gate 46 is provided for supplying a count pulse synchronized with the head portion of the respective operator time slots in response to the timing signal 1Y16. The counter 47 is so constructed that it is repeatedly cleared at the end of one cycle of the tone synthesis operation processing (96 time slots) in response to the timing signal 96Y96 (FIG. 2(*c*)). Accordingly, the number of the final operator timing pulses read out from the ROM 44 while the operator time slots OP 6–OP 1 circulate once is counted by the counter 47. This counted value of the counter 47 is latched by a latch circuit 48 at a timing of the timing signal 95Y96 (FIG. 2(*c*)). In other words, the result of counting in the counter 47 is latched by the latch circuit 48 immediately before the counter 47 is cleared. Thus, the number of the final operator in the presently selected algorithm number, i.e., the numerical value representing the addition channel number, is latched by the latch circuit 48.

The AND gate 45 is provided for cancelling, among the final operator timing pulses read out from the ROM 44, a pulse corresponding to the operator inhibited by the switch manipulation of the operator inhibition switch and indicator 34. The operator inhibition signals DIS 1–DIS 6 outputted by the operator inhibiting switch and indicator 34 are supplied to a multiplexing circuit 49 in which multiplexing operation is made in response to the timing signals representing the operator time slots OP 6–OP 1 and an output pulse is produced at a time slot of the inhibited operator. This pulse signal representing the inhibited operator timing is inverted by an inventer 50 and thereafter is applied to the AND gate 45. At the timing of the inhibited operator, the output of the inverter 50 is turned to "0" thereby disabling the AND gate 45. Consequently, the pulse corresponding to the inhibited operator among the final operator timing pulses read out from the ROM 44 is cancelled by the AND gate 45. If, for example, the output of the operator 1 is inhibited when the algorithm number is 1, a pulse at the time slot OP 1 is cancelled among pulses read out from the ROM 44 at the time slots OP 3 and OP 1 so that the counter 47 makes a single counting at the time slot OP 3.

The pulse outputted from the AND gate 45 and synchronized with the time sot of the final operator is applied to a control input of a gate 51. The gate 51 gates out the numerical data representing the addition channel number latched by the latch circuit 48 in response to the pulse applied to the control input, thereby outputting this numerical data as the addition channel number signal ADN. The addition channel number signal ADN, therefore, is a signal which the numerical data representing the addition channel number generates intermittently in synchronism with the time slot of the final operator. If, for example, neither the final operator 1 nor 3 is inhibited when the selected algorithm number is 1, a signal representing numerical value "2" as the addition channel number signal ADN is generated in the operator time slots OP 3 and OP 1.

Figure 8:
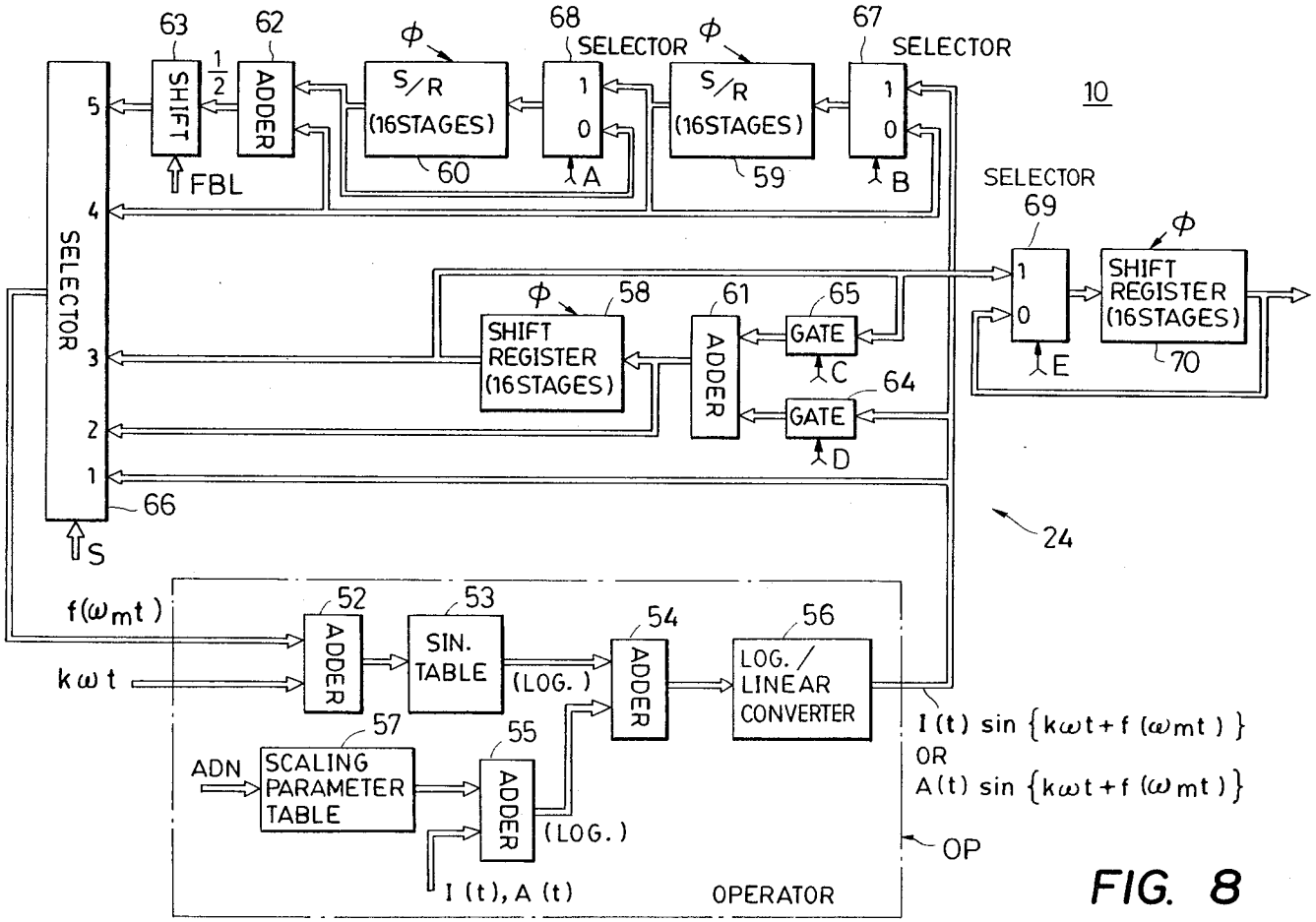
FIG. 8 is an electrical block diagram showing an example of operator as a hardware, algorithm switching gate and register section included in the tone generator of FIG. 1.

An example of each of the operator OP and the algorithm switching gate and register section 24 is shown in FIG. 8.

Referring to FIG. 8, the operator OP comprises an adder 52 which adds the phase angle data $k\omega t$ provided by the phase generator 13 (FIG. 1) and a desired waveform signal $f(\omega_m t)$ provided by the gate and register section 24, and a sine wave table 53 which reads out a sine function valve using the output signal of this adder 52 as phase angle data. The operator OP thus effects a basic frequency modulation operation using the phase angle data $K\omega t$ as phase angle data of the carrier signal and the waveform signal $f(\omega_m t)$ as the modulating signal. The sine wave table 53 provides an instantaneous amplitude value of the frequency modulated signal, i.e., $\sin\{k\omega t+f(\omega_m t\}$. For simplifying the operation circuit by substituting a linear multiplication operation by a logarithmic addition, the sine wave table 53 stores sine function values in logarithm. The waveform signal $f(\omega_m t)$ applied to the modulating signal input at a given operator time slot is an output signal of the operator OP obtained at other operator time slot (or its own operator time slot). If no operator is connected to the modulating signal input as in the operator 2 in FIG. 5, A-1, the waveform signal $f(\omega_m t)$ is zero and the operator OP generates a sine signal $\sin K\omega t$ only.

The adder 54 is scaler means for multiplying the waveform signal read out from the sine wave table 53 with the amplitude coefficient. Since the waveform signal read out from the sine wave table 53 is expressed in logarithm, the addition by the adder 54 is equivalent to linear multiplication. The adder 54 receives at one input thereof the output of the sine wave table 53 and at the other input thereof the modulation index I(t) or the amplitude coefficient A(t) through an adder 55. While the modulation index I(t) and the amplitude coefficient A(t) are both coefficients for controlling the level of the waveform signal, coefficients corresponding to the final operators (e.g. the operators 1 and 3 in FIG. 5, A-1) are herein referred to as the amplitude coefficients A(t) and ones corresponding to the other operators (e.g. the operators 2, 4, 5 and 6 in FIG. 5, A-1) as the modulation index I(t). Since the outputs of operators other than the final operators are inputted as modulating signal to other operators, their level control coefficients may properly be named the modulation index I(t).

As was described previously, the modulation index I(t) or the amplitude coefficient A(t) is generated by the envelope generator 25 (FIG. 1) and changes with time in response to the envelope shape formed on the basis of the control data L1–L4 and R1–R4 (or it may remain constant). This envelope shape signal generated by the envelope generator 25, i.e., the modulation index I(t) or the amplitude coefficient A(t) is expressed in logarithm. Accordingly, by addition of two values expressed in logarithm, the adder 54 outputs, in logarithm, a product obtained by multiplying the output waveform signal from the sine wave table 53 by the coefficient, i.e., I(t) $\sin\{k\omega t+f(\omega_m t)\}$ or A(t) $\sin\{k\omega t+f(\omega_m t)\}$. The output signal expressed in logarithm from the adder 54 is converted to a linear expression by a logarithm-linear converter 56.

A scaling parameter table 57 prestores a level adjusting parameter corresponding to the addition channel number and provides a predetermined level adjusting parameter in response to the addition channel number signal ADN supplied by the addition channel number signal generator 42 (FIG. 1 and FIG. 7). The level adjusting parameter read out from the table 57 is also expressed in logarithm and added to the amplitude coefficient A(t) in the adder 55 to modify the value of the coefficient A(t). As the level of the output signal of the sine wave table 53 is controlled by the adder 54 in response to the modified amplitude coefficient A(t), the output signal level is adjusted in response to the addition channel number. The value of the level adjusting parameter stored in the table 57 is set to such a value as, for example, the output signal level falls as the addition channel number increases. As described above, the addition channel number signal ADN is supplied to time slots of the final operators. Accordingly, it is only at the time slots of the final operators that the output signal level is adjusted in response to the addition channel number. At other operator time slots, the modulation index I(t) provided by the envelope generator 25 is applied directly to the adder 54 passing through the adder 55.

The operator OP effects frequency modulation operation for 16 tones (channels) in time division with respect to one operator time slot and successively performs this frequency modulation operation for the six operators 1–6 during one cycle (96 time slots) of the operation for tone synthesis. As shown in FIG. 2(*b*), the operator time slots OP 6–OP 1 occur in the order of the operators 6, 5, 4, 3, 2 and 1. In one operation cycle (96 time slots), therefore, the operator OP performs frequency modulation operation for 16 tones (channels) concerning the operator 6 at the first 16 time slots, operation for 16 tones concerning the operator 5 at next 16 time slots and, subsequently, operations for 16 channels concerning the respective operators 4, 3, 2 and 1 at respective 16 time slots (i.e., OP 4, OP 3, OP 2 and OP 1) in sequence.

In the hardware aspect of the operator OP, a time delay of 16 time slots is provided between input and output thereof. For example, the result of operation concerning the phase angle data $k\omega t$ inputted to the adder 52 at a timing of channel 1 of the operator time slot OP 6 is outputted from the logarithm-linear converter 56 with a delay of 16 time slot (i.e., at a timing of channel 1 of the operator time slot OP 5). Such delay of 16 time slots is set by insertion of a suitable delay circuit, whose illustration is omitted, inconsideration of the time necessary for the operation in the operation circuit.

The output of the logarithm-linear converter 56 is inputted to the gate and register section 24 as the output signal of the operator OP. The gate and register section 24 comprises shift registers 58, 59 and 60 to temporarily store and hold the operated output signal of the operator, an adder 61 to add the output signals of two or more different operators, an adder 62 to form the feedback signal of the circulating type operator, a shift circuit 63 to control the level of this feedback signal, gates 64 and 65 and selectors 66, 67, 68 and 69. The output signal of the operator OP is applied to the input "1" of the selector 66 and the inputs "1" of the gates 64 and 67, respectively. The gates 64 and 65 are provided to select the output signal of the operator to be added by the adder 61. The output of the adder 61 is applied to the inputs "2" of the shift register 58 and selector 66. The output of the shift register 58 is applied to the input "3" of the selector 66 and the inputs "1" of the gate 65 and selector 69. The output of the selector 69 is applied to an output shift register 70 of which the output circulates through the input "0" of the selector 69. The output of the selector 67 is applied to the shift register 59 of which the output is applied to the input "4" of the selector 66, the input "0" of the selector 67, the input "1" of the selector 68 and the adder 62. The output of the selector 68 is applied to the shift register 60. The output of the shift register 60 is applied to the input "0" of the selector 68 and the adder 62. The output of the adder 62 is applied to the shift circuit 63 of which the output is applied to the input "5" of the selector 66. The shift registers 58 to 60 and 70 have 16 stages respectively and are shift controlled by the clock pulse $\phi$.

Out of the sequence codes A–E and S generated by the sequence code generator 26 (FIG. 1), the signals A, B and E are applied to the selection control inputs of the selectors 68, 67 and 69, respectively. The selectors 67 to 69 select the input "1" when the signal applied to the selection control input is "1" and select "0" when such signal is "0". Out of the sequence codes, the signals C and D are applied to the control inputs of the gates 65 and 64. The gates 64 and 65 are closed when the signal applied to the control input is "0" and open when "1". Out of the sequence codes, the multi-bit code signal S is applied to the selection control input of the selector 66. The selector 66 either selects one or none of the five inputs "1" to "5" in response to the contents of the selection code signal S applied to the control input. The output signal of the selector 66 is applied to the adder 52 as modulating signal input $f(\omega_m t)$ of the operator OP. To the shift amount control input of the shift circuit 63 is applied the feedback level data FBL from the counter 40 shown in FIG. 1. In the algorithm switching gate and register section 24, the connections of the circuits change in response to the sequence codes A–E and S which change their contents according to the operator time slots, thus realizing a predetermined input and output connection combination between the operators 1 to 6.

Figure 9:
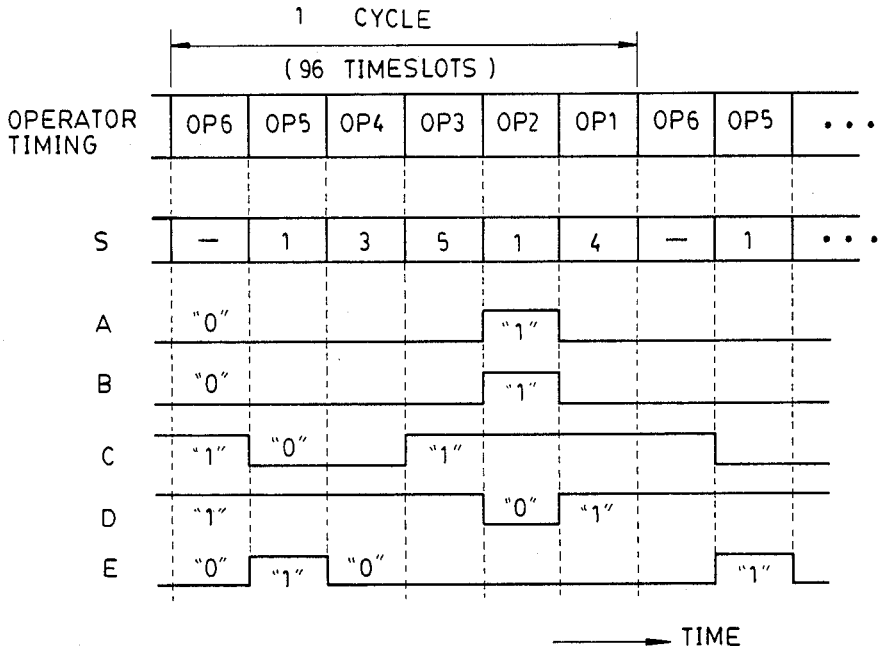
FIG. 9 is a time chart showing contents of a sequence code for realizing algorithm shown in A-19 in FIG. 5.

Description will now be made of an example where the connection between operators with the algorithm No. 19 shown in FIG. 5, A-19. In this case, the sequence codes A–E and S are generated in response to the respective operator time slots OP 6–OP 1 as shown in FIG. 9. The numerals 1, 3, 5, . . . given in the row of the selection code signal S identify the inputs of the selector 66 selected by the signal S.

At the first operator time slot OP 6 in one cycle of the operation, the operator OP performs the operation of the operator 6. In algorithm No. 19, the operator 6 does not perform the frequency modulation operation so the selector 66 does not select any of the inputs.

The output signal regarding the operator 6 is outputted from the operator OP with the delay of 16 time slots at the operator time slot OP 5. At that time, the selector 66 selects the input "1" in response to the selection code signal S. Accordingly, when the operator OP performs the operation regarding the operator 5 at the operator time slot OP 5, the output signal of the operator 6 is applied as $f(\omega_m t)$ to the modulating signal input through the input "1" of the selector 66, thus realizing the operator connection where the output of the operator 6 is connected to the modulating signal input of the operator 5. Meanwhile, at the time slot OP 5, the signal D is "1" and the gate 64 is opened so that the output signal of the operator 6 is stored in the shift register 58 through the adder 61.

The output signal regarding the operator 5 is outputted with the delay of 16 time slots at the time slot OP 4 from the operator OP. At the time slot OP 4, the output of the operator 6 is outputted from the shift register 58. At that time, the selctor 66 selects the input "3" in response to the signal S. Accordingly, when the operator OP performs the operation regarding the operator 4 at the operator time slot OP 4, the output signal of the operator 6 is applied to the modulating signal input through the input "3" of the selector 66, thus realizing the connection between operators wherein the output signal of the operator 6 is connected to the modulating signal input of the operator 4. Meanwhile, at the time slot OP 4, the signal D is "1" and the gate 64 is opened so that the output signal of the operator 5 is stored in the shift register 58.

The output signal of the operator 4 is outputted with the delay of 16 time slots at the time slot OP 3 from the operator OP. At the same time, the output signal of the operator 5 is outputted from the shift register 58 when the signals C and D become "1" to open the gates 64 and 65. Accordingly the adder 61 adds the output signal of the operator 5 outputted from the shift register 58 and the output signal of the operator 4 outputted from the operator OP and the addition result is stored in the shift register 58, thus realizing the operator connection wherein the output signals of the operators 4 and 5 are added.

Meanwhile at the time slot OP 3, the input "5" of the selector 66 is selected and the feedback signal outputted from the shift circuit 63 is applied to the modulating signal input of the operator OP. Accordingly, the operation of the operator 3 performed in the operator OP at the time slot OP 3 is the circulating type frequency modulation operation and the connection wherein the operator 3 is the circulating type operator is realized. As will be described, there is stored in the shift register 59 the output signal of the operator 3 in the last operation cycle while in the shift register 60 the output of the operator 3 in the operation cycle preceding the last cycle. The adder 62 is provided to obtain the average of the last output signal and the last but one output signal. The outputs of the registers 59 and 60 are added by the adder 62, shifted to the lower digit by one digit, divided by 2 and then applied to the shift circuit 63. Such averaging operation serves to the prevent the hunting phenomenon in the circulating type frequency modulation operation. The shift circuit 63 controls the level of the fed-back signal in response to the feedback level FBL predetermined in the manner described above.

The output signal of the operator 3 is outputted from the operator OP with the delay of 16 time slots at the operator time slot OP 2. At that time, the selector 66 selects the input "1" in response to the selection code signal S. Accordingly, when the operation of the operator 2 is performed in the operator OP at the time slot OP 2, the output signal of the operator 3 is applied to the modulating signal input of the operator OP, thereby realizing the operator connection wherein the output of the operator 3 is connected to the modulating signal input of the operator 2.

At the time OP 2, meanwhile, the signals A, B and C become "1". The signal signal C opens the gate 65 so that the result of addition of the operators 4 and 5 outputted from the shift register 58 is fed back to the shift register 58 through the adder 61. Meanwhile the input "1" of the selector 68 is selected in response to "1" of the signal A so as to transfer the last output signal of the operator 3 stored in the shift register 59 to the shift register 60. At the same time, the input "1" of the selector 67 is selected in response to "1" of the signal B so as to store the present output signal of the operator 3 outputted from the operator OP in the shift register 59. At the following time slots OP 1 to OP 3 where the signals A and B fall to "0", the selectors 67 and 68 allow the signals stored in the shift registers 59 and 60 to circulate through the inputs "0". As a result, at the time slot OP 3 in the following operation cycle, the last but one output signal regarding the operator 3 is outputted from the register 60 while the last output signal is outputted from the register 59.

The output signal of the operator 2 is outputted from the operator OP with the delay of 16 time slots at the operator time slot OP 1. At that time, the output signal of the operator 3 is outputted from the register 59. At the time slot OP 1, the input "4" is selected in the selector 66 in response to the selection signal S and the output signal of the operator 3 outputted from the shift register 59 is applied to the modulating signal input of the operator OP, thus realizing the connection wherein the output of the operator 3 is connected to the modulating signal input of the operator 1. At the time slot OP 1, meanwhile, the signals C and D go to "1" to open the gates 64 and 65 so that the adder 61 adds the output addition signal of the operators 4 and 5 to the output signal of the operator 2 outputted from the operator OP and the addition result is stored in the shift register 58, thereby realizing the connection wherein the output signals of the operators 2, 4 and 5 are added.

The output signal of the operator 1 is outputted from the operator OP with the delay of 16 time slots at the operator time slot OP 6 in the following operation cycle. At that time, the signals C and D are both "1" to open the gates 64 ad 65. Accordingly, the adder 61 adds the output addition signal of the operators 2, 4 and 5 outputted from the shift register 58 to the output signal of the operator 1 and the addition result is stored in the shift register 58, thus realizing the connection wherein the output signals of the operators 1, 2, 4 and 5 are finally added. That final addition result is outputted from the shift register 58 sixteen time slots later at the operator time slot OP 5. The signal E becomes "1" at the time slot OP 5 so that the output signal of the shift register 58 is selected through the input "1" of the selector 69 and stored in the output shift register 70. At the following time slots OP 4 to OP 6 where the signal E falls to "0", the selector 69 allows the memory of the shift register 70 to circulate through the input "0". Thus the tone signals for 16 channels obtained in one operation cycle are held in the output shift register 70 for one operation cycle (96 time slots) and outputted from the shift register 70 in time division. The tone signals for the respective channels outputted from the shift register 70 are applied, through appropriate processings where necessary, to the sound system 71 (FIG. 1).

Thus the sequence codes A–E and S shown in FIG. 9 realize the algorithm (connection between operators) with No. 19 shown in FIG. 5, A-19. While the contents of the sequence codes A–E and S for the algorithms with the other numbers are not described, they will be easily understood by the analogy of the above example and the connections shown in FIG. 5.

Figure 10:
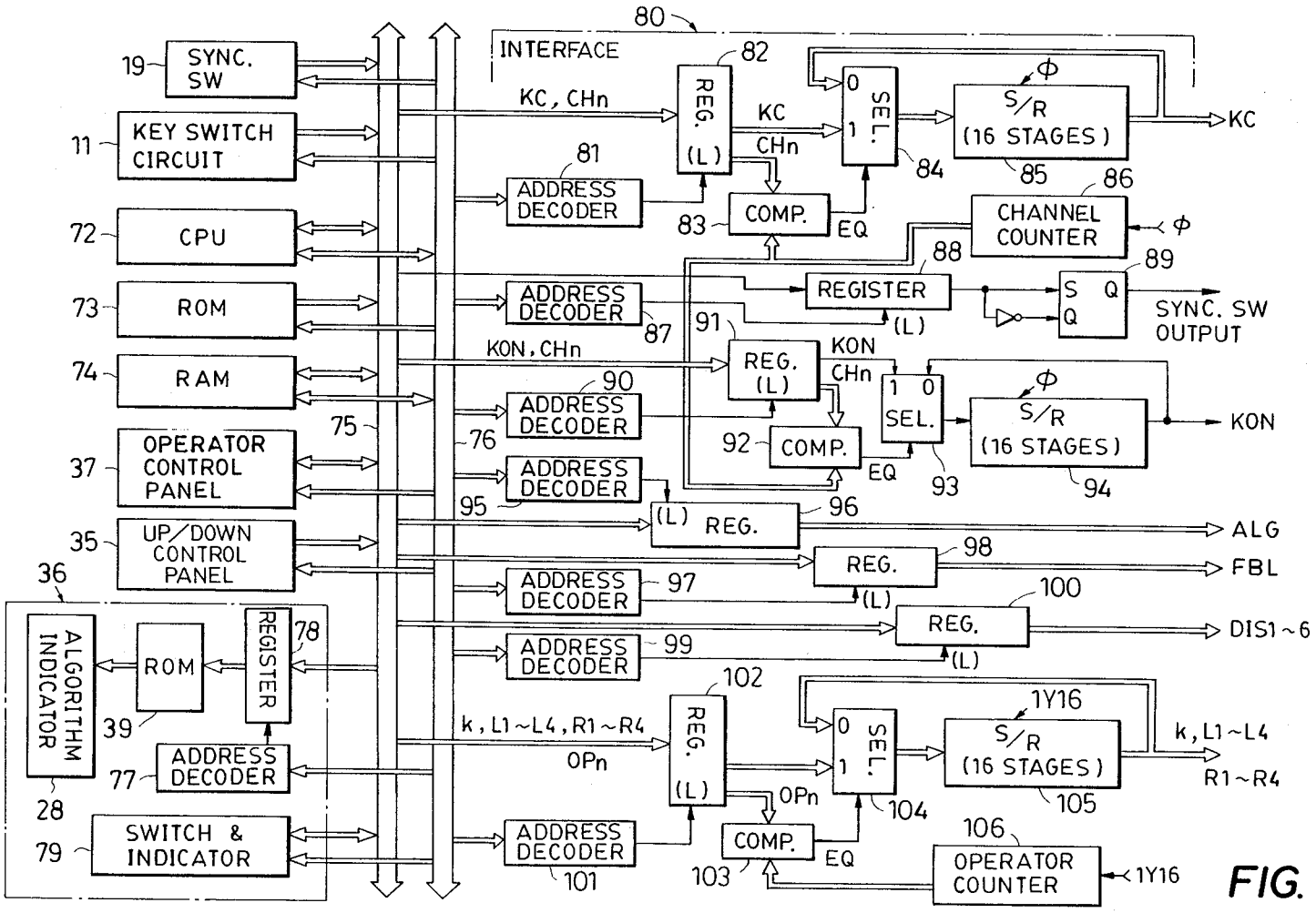
FIG. 10 is an electrical block diagram showing an example of construction of the key switch circuit, key assigner and setting section in FIG. 1 by using a microcomputer.

The key switch circuit 11, key assigner 12, setting section 27 and synchronizing switch 19 shown in FIG. 1 may be made using a microcomputer as shown in FIG. 10.

Referring to FIG. 10, the microcomputer comprises a central processing unit (CPU) 72, program ROM 73 and working RAM 74. The key switch circuit 11, synchronizing switch 19, up-down control panel 35, algorithm control panel 36 and operator control panel 37 are connected to a data bus 75 and address bus 76 of the microcomputer. Each of the panels 35, 36 and 37 comprises the previously described switch and indicator as well as a register corresponding to the indicator. Referring in particular to the algorithm control panel 36, it comprises afore-mentioned algorithm indicator 28 and indication pattern ROM 39 and a further provided with an address decoder 77 and register 78 to load the data indicating the algorithm number. The switch and indicator 79 generally designates the algorithm number selection switch 29, feedback level indicator 30, feedback level selection switch 31, operator selection switch and indicator 33, and operator inhibition switch and indicator 34 shown in FIGS. 1 and 4.

The ON-OFF key detection scanning by the key switch circuit 11 and the assignment to the individual channels based thereon (by the key assigner 12) are performed by a microcomputer. The detection of the switching operation in the panels 35 to 37 and the setting operation of various data corresponding to said switching operation are also performed by a microcomputer.

The algorithm indication will now be described by way of an example of set contents indicating means. When the data which indicates the presently set algorithm number is applied to the data panel 75, the address signal for the algorithm number is simultaneously applied to the address panel 76. The address decoder 77 of the algorithm control panel 36 decodes the address signal of the algorithm number applied to the address bus 76 and loads the register 78 with the data of the data bus 75 or data indicating the algorithm number based on the deocde output. The algorithm number data loaded in the register 78 is inputted to the ROM 39 and the indication pattern corresponding to the algorithm number is read out from the ROM 39 and indicated by the indicator 28. The indication data is distributed to the other indicators in like manner.

An interface unit 80 is provided to supply various data obtained through processings by microcomputers to the tone generator 10, phase generator 13, envelope generator 25, sequence code generator 26 and addition channel number generator 52 shown in FIG. 1.

The interface unit for the key code KC comprises an address decoder 81, register 82, comparator 83, selector 84 and 16-stage shift register 85. When a newly depressed key has been assigned to an available channel, that is, when there has occurred an event as to the key assingment, the key code KC indicating that newly depressed key and the channel number data CHn indicating the channel to which that key code KC has been asisgned are applied to the data bus 75 while at the same time the address signal for the key code KC is applied to the address bus 76. The address decoder 81 decodes the address signal for the key code KC and applies the decode output to the load control input (L) of the register 82. Based on the output of the decoder 81, the register 82 is loaded with the key code KC and channel number data CHn of the data bus 75. The key code KC loaded in the register 82 is applied to the input "1" of the register 84. The selector 84 selects "1" in response to "1" of the control signal applied from the comparator 83 and selects "0" in response to "0" of the control signal. The output of the selector 84 is inputted to the shift register 85 from which it is outputted after being delayed by 16 time slots according to the clock pulse $\phi$. The output of the shift register 85 is applied to the input "0" of the selector 84. The channel number data CHn loaded in the register 82 is inputted to the comparator 83. The other input of the comparator 83 is supplied with the output of a channel counter 86. The channel counter 86 is a modulo 16 counter and counts the clock pulse $\phi$. Accordingly the count of the channel counter 86 changes in synchronism with the first to 16th channel timings shown in FIG. 2(*a*), successively designating the channel numbers corresponding to the channel timings. The comparator 83 outputs and applies the signal "1" as the coincidence output EQ to the selector 84 when the channel number count data supplied from the counter 86 coincides with the channel number data CHn supplied from the register 82. Therefore, the key code KC of the register 82 is selected by the selector 84 in synchronism with the time division timing of the channel to which the key code KC has been assigned and loaded in the shift register 85. The selector 84 normally selects "0" in response to the output signal "0" of the comparator 83 so that the key code KC loaded in the shift register 85 at a channel timing circulates through the register 85 in synchronism with that channel timing. Thus the shift register 85 outputs, in time division, the key code KC of the keys assigned respectively to the 16 channels. The output key code KC of the shift register 85 is applied to the phase generator 13 shown in FIG. 1.

The interface unit for the output signal of the synchronizing switch 19 comprises an address decoder 87, register 88 and flip-flop 89. The address decoder 87 decodes the address signal indicating that the data showing the to ON-OFF state of the synchronizing switch 19 has been applied the data bus 75 and the register 88 is loaded with the ON-OFF data of the data bus based on the decode output. Said data showing the ON-OFF state is applied to the data bus 75 when the synchronizing switch 19 is turned from ON to OFF or OFF to ON, that is, at the time of an event. The flip-flop 89 is set when the output signal of the register 88 is "1" and reset when "0". The set output (Q) of the flip-flop 89 is applied to the AND gate 20 shown in FIG. 1 as the output signal of the synchronizing switch 19.

The interface unit for the key-on signal KON comprises an address decoder 90, register 91, comparator 92, selector 93 and 16-stage shift register 94. At the time of the event as to the key-on signal KON, that is, when the key-on signal KON of a certain channel is turned from "0" to "1" or vice versa, the contents of that key-on signal KON and its channel number data CHn are applied to the data bus 75 while the address signal corresponding thereto is applied to the address bus 76. The address decoder 90 decodes the address signal for the key-on signal KON and, based thereon, loads the register 91 with the key-on signal KON and the channel number data CHn of the data bus 75. The comparator 92, selector 93 and shift register 94 perform the same operations as the before-mentioned circuits 83, 84 and 85 for the key code KC so that the key-on signals KON of the respective channels are stored in the shift register 94 and outputted in time division according to the channel timings shown in FIG. 2(*a*).

An address decoder 95 and register 96 are interface circuits for the algorithm number ALG, an address decoder 97 and register 98 are interface circuits for the feedback level data FBL and an address decoder 99 and register 100 are interface circuits for the operator inhibition signal DIS 1 to 6. As in the previous case, the contents of these signals and data are applied to the data bus 75 as they change while at the same time, the address signal is applied to the address bus 76 and, based on this, various data and signals are loaded in the registers 96, 98 and 100.

Figure 11:
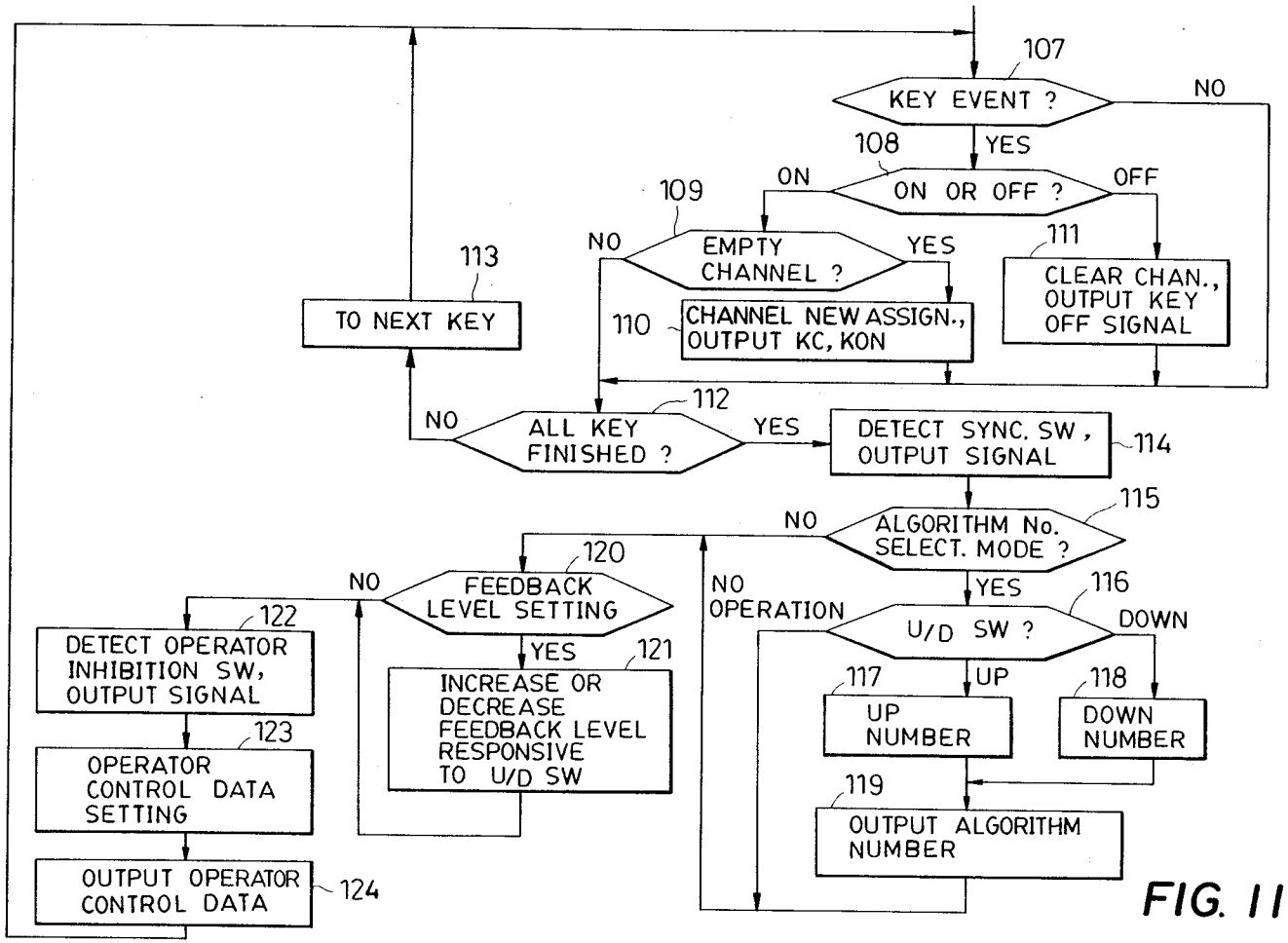
FIG. 11 is a flow chart showing an example of outline of processing carried out by the microcomputer of FIG. 10.

The interface unit for the operator control data k, L1 to L4 and R1 and R4 comprises an address decoder 101, register 102, comparator 103, selector 104 and 16-stage shift register 105. Each stage of the shift register 105 corresponds to 6 operators. The timing signal 1Y16 is used as its shift control clock. When the set contents of the operator control data has been changed, the data k, L1 to L4 and R1 to R4 and the operator number data OPn indicating the operator number (either one of 1 to 6) are applied to the data bus 75 and, at the same time, the address signal corresponding thereto is applied to the address bus 76. As in the previous case, the address signal for the operator control data is decoded by the address decoder 101 and based on the decode output, each of these data is loaded in the register 102. The operator control data k, L1 to L4 and R1 to R4 stored in the register 102 are inputted to the input "1" of the selector 104 while the operator number data OPn is inputted to the comparator 103. The operator counter 106 is a modulo 6 counter and counts the timing signal 1Y16. Accordingly, the state of the operator counter 106 changes in synchronism with the operator time slots OP 6 to OP 1 shown in FIG. 2(*b*), successively designating the operator number 6 to 1 corresponding to the time slots OP 6 to OP 1. The comparator 103 compares the operator number count data supplied from the counter 106 with the operator number data OPn supplied from the register 102 and outputs the signal "1" when they coincide with each other. Based on the coincidence signal, the operator control data of the register 102 is selected through the input "1" of the selector 104 and stored in the shift register 105. Normally, the output signal of the comparator 103 is "0" so that the contents of the shift register 105 circulates through the input "0" of the selector 104. The data k, L1 to L4 and R1 to R4 that were set so as to correspond to the respective operators are outputted in time division from the shift register 105 in synchronism with the respective operator time slots OP 6 to OP 1. FIG. 11 diagrammatically shows the processing carried out by the microcomputer (72, 73 and 74). The routine consisting of blocks 107 to 113 performs scanning of the key switches of the key switch circuits 11 and assignment (function of the key assigner 12) to the respective channels based on the scanning result. The "key event?" of the block 107 examines whether the key switch presently scanned has changed from ON to OFF or conversely. If change is not detected, a step is made by jumping to a block 112. If change is detected, a step is made to a block 108 to see whether the key switch has changed to ON or OFF. In case of change to ON, a step is then made to a block 109 to see whether there is an empty channel. If an empty channel is found, a step is made to a block 110 to register a new depressed key (a key corresponding to the presently scanned key switch) in that empty channel and output its key code KC and key-on signal KON(="1") together with the channel number data CHn to the interface unit 80. In case the key switch has changed to OFF, it proceeds to a block 111 to clear (empty) the channel to which that key has been assigned and outputs the signal (KON="0") indicating key-off to the interface unit 80 together with the channel number data CHn.

A block 112 examines whether the scanning of all the key switches has been completed and, in case of NO, a step is made so as to return to the block 107 through a block 113 in order to advance the scanning to the next key switch. If the scanning of all the key switches has been completed, detection of the switching operation in the panel section is then conducted.

A block 114 detects the state of the synchronizing switch 19 and, in case it has changed, supplies its output signal to the interface unit 80 as described above.

Blocks 115 to 119 constitute a routine related to the selection of an algorithm number. The block 115 examines whether the algorithm number selection switch 29 has been turned on and, if the switch 29 is found to have been turned on, sets the algorithm number selection mode to proceed to a block 116. The block 116 examines whether the switch U-SW or the down switch D-SW has been operated. If the up switch U-SW has been operated, the present value of the algorithm number is counted up by one in a block 117 while if the down switch D-SW has been operated, the present value of the algorithm number is counted down by one in a block 118. A block 119 supplies the data showing the newly set algorithm number to the algorithm control panel 36 and interface unit 80.

A block 120 examines whether the feedback level selection switch 31 has been turned on and, if the switch 31 is found to have been turned on, sets the feedback level setting mode to proceed to a block 121. The block 121 increases or decreases the present value of the feedback level in response to the operation of the up switch U-SW or the down switch D-SW and supplies the obtained new feedback level data to the algorithm control panel 36 and the interface unit 80. It is noted that the algorithm number selection mode and the feedback level setting mode are not set simultaneously but exclusively, i.e., one is set when the other is reset.

A block 122 detects the state of the operator inhibition switch 34 (DIS-SW) and if it has changed, supplies its output signal to the interface unit 80.

A block 123 detects the state of the operator selection switch 33 (SEL-SW) and the operation of the switches in the operator control panel 37 and, based thereon, modifies the setting of the operator control data k, L1 to L4 and R1 to R4. A block 124 outputs the newly set operator control data to the indicator of the operator control panel 37 and the interface unit 80.

FIG. 8, the sine wave table of the operator OP may be replaced with a cosine wave table or any other wave generation table.

The invention may of course be carried out according to the above example in respect of electronic musical instruments which synthesize tones my amplitude modulation operation within the audio frequencies.

What is claimed is:

1. An electronic musical instrument comprising:

a plurality of operation units respectively performing a predetermined waveform generation operation using a phase signal or a waveform signal applied to one or more inputs thereof as a parameter;

setting means for variably setting a combination of input and output connections between said respective operation units;

connection switching means for switching connections between said respective operation units in response to the combination of connections set by said setting means; and which further comprises indication means for visually indicating the combination of connections set by said setting means.

2. An electronic musical instrument as defined in claim 1 wherein said indication means visually indicates the combination of connections by an operation unit indication indicating each of said operation units and an indication of a connection line connecting said respective operation units.

3. An electronic musical instrument as defined in claim 2 wherein said indication means has a predetermined additional indication added to one of said operation unit indications corresponding to an operation unit whose input and output connection is set such that an output signal thereof is fed back to an input side thereof.

4. An electronic musical instrument as defined in claim 1 wherein said setting means effects setting by selecting one of previously prepared combinations of connections.

5. An electronic musical instrument as defined in claim 1 wherein at least one operation unit comprises an adder which adds the signals applied to said one or more inputs and a waveform memory which reads out a waveform signal using the output signal of said adder as phase data.

6. An electronic musical instrument as defined in claim 1 wherein said predetermined waveform generation operation to be performed in at least one operation unit is a frequency modulation operation.

7. An electronic musical instrument as defined in claim 1 wherein said predetermined waveform generation operation to be performed in at least one operation unit is an amplitude modulation operation.

8. An electronic musical instrument as defined in claim 1 which further comprises phase generation means for generating a phase signal which changes at a rate harmonized with the frequency of a note to be generated, said phase signal being applied to at least one of said operation units.

9. An electronic musical instrument as defined in claim 8 wherein said phase signal is applied to one input of each of said operation units and an output of another operation unit or an output of itself is applied to another input of each of said operation units in response to said set combination of connections.

10. An electronic musical instrument as defined in claim 2 wherein said plurality of operation units are realized by using a single operation circuit on a time shared basis at time slots individually allotted to said respective operation units.

11. An electronic musical instrument comprising:

a plurality of operation units respectively performing a predetermined waveform generation operation using a phase signal or a waveform signal applied to one or more inputs thereof as a parameter;

setting means for variably setting a combination of input and output connections between said respective operation units;

connection switching means for switching connections between said respective operations units in response to the combination of connections set by said setting means, and which further comprises output inhibit selection means for inhibiting an output signal of an operation unit selected by said selection means.

12. An electronic musical instrument comprising:

a plurality of operation units respectively performing a predetermined waveform generation operation usng a phase signal of a waveform signal applied to one or more inputs thereof as a parameter;

setting means for variably setting a combination of input and output connections between said respective operations units;

connection switching means for switching connections between said respective operation units in response to the combination of connections set by said setting means; and which further comprises detection means for detecting, responsive to the combination of connections set by said setting means, the number of operation units which finally provide tone signals, and means for automatically adjusting, responsive to the number which has been detected by said detection means, the levels of output signals of said operation units which finally provide tone signals.

13. An electronic musical instrument comprising:

phase generation means for generating phase data which changes at a rate corresponding to the frequency of a note to be generated;

a plurality of operation units having first and second inputs and performing a predetermined waveform generation operation in response to signals applied to said first and second inputs, at least said first input receiving the phase angle data generated by said phase generation means;

control signal generation means generating signals for controlling the levels of output signals of said respective operation units as a function changing with time which initiates from start of sounding of a tone and supplying these signals to said respective operation units;

first setting means for variably setting a combination of input and output connections between said respective operation units;

second setting means for variably setting parameters of the control signal function generated by said control signal generation means in response to said respective operation units; and connection switching means for respectively switching a state of connection between said second input and the output of said respective operation units in accordance with the combination of connections set by said first setting means.

14. An electronic musical instrument comprising:

tone pitch designating means for designating a pitch of a tone to be produced and for producing phase angle information corresponding to said designated pitch;

tone signal generating means for generating, on receipt of said phase angle information, a tone signal relative to said tone pitch;

said tone signal generating means comprising a set of algorithm performing units arbitrarily selectably interconnectable for performing a plurality of sequences of operation algorithms, each individual algorithm performing unit providing respectively a modulation operation of a carrier signal having a phase angle representative of said phase angle information in accordance with a modulation signal and providing a modulated carrier signal as the result of said modulation operation;

algorithm sequence designating means for arbitrarily designating an interconnection scheme between the units in said set of algorithm performing units, thereby to implement a corresponding selected algorithm sequence of said operation algorithms by utilizing, for the modulation signal of at least one operation algorithm said tone signal, the modulated carrier signal provided by said at least one algorithm performing unit or by another algorithm performing unit, or the modulated carrier signals of more than one other algorithm performing unit.

15. An electronic musical instrument according to claim 14 which further comprises:

display means for displaying said algorithm sequence as the connection of units of said tone signal generating means, each such unit representing the portion of said tone generation means which performs a respective one of said operation algorithms.

16. An electronic musical instrument according to claim 14 wherein said algorithm sequence designating means, in which a plurality of algorithm sequences are set in advance, selects one from among said plurality of algorithm sequences thereby designating said selected algorithm sequence.

17. An electronic musical instrument according to claim 14 which further comprises:

number detecting means for detecting the number of the operation algorithms which are utilized for the generation of said tone signal; and level adjusting means for adjusting the level of said tone signal in accordance with said detected number.

18. An electronic musical instrument according to claim 14 wherein:

said modulation operation is frequency modulation.

19. An electronic musical instrument according to claim 14 wherein said tone signal generating means comprises operating circuit means for performing a predetermined number of operation algorithms on time division basis.

20. An electronic musical instrument according to claim 19 wherein said operating circuit means comprises:

adding means for adding said phase angle information and said modulation signal; and memory means for storing a sine or cosine waveshape and for reading out said waveshape in accordance with the output of said adding means thereby performing frequency modulation operation.

21. An electronic musical instrument according to claim 14 wherein:

said modulation operation is amplitude modulation.

22. An electronic musical instrument according to claim 14 wherein:

said modulation operation is phase modulation.

23. An electronic musical instrument comprising:

a plurality of operation units each respectively performing a predetermined waveform generation operation using a phase signal or a waveform signal applied to one or more inputs thereof as a parameter, said operation being a modulation operation;

setting means for arbitrarily selecting one from among a plurality of different combinations of input and output interconnections between said respective operation units, each different combination of interconnections resulting in the performance by said plurality of units of a corresponding different sequence of waveform generation operations, and connection switching means for switching connections between said respective operation units in response to the combination of connections selected by said setting means.

* * * * *